United States Patent [19]

Sims

[11] 3,994,037

[45] Nov. 30, 1976

[54] BRUSH EXTENSION ARM

[75] Inventor: Alex Sims, San Bruno, Calif.

[73] Assignee: Lawrence Peska Associates, Inc., New York, N.Y. ; a part interest

[22] Filed: July 24, 1975

[21] Appl. No.: 598,629

[52] U.S. Cl. ..... 15/146

[51] Int. Cl.[2] ..... A46B 5/00

[58] Field of Search ..... 15/145, 144, 146, 172, 15/160

[56] References Cited

UNITED STATES PATENTS

| | | | |
|---|---|---|---|
| 1,416,081 | 5/1922 | White | 15/146 |
| 1,897,058 | 2/1933 | Kling | 15/160 |
| 3,205,522 | 9/1965 | Then | 15/146 |
| 3,336,617 | 8/1967 | Bosko et al. | 15/160 |
| 3,928,886 | 12/1975 | Marino et al. | 15/144 |

*Primary Examiner*—Richard E. Aegerter
*Assistant Examiner*—John W. Shepperd

[57] ABSTRACT

An adjustable extension for a brush which enables the operator to cover difficult to reach areas; the brush is positional in a plurality of fixed angles for ease of working with the same.

5 Claims, 6 Drawing Figures

16
12
34
36
28
10
32
30
44
22
22a
42
24a
18
20
24
40
26
38
28
30
22a
16
12
22
40
24
26
28
24a
40
30
16
12
40
24
24a
42
30
16
12
34
36
30
16
12
22
34
40
36
24
24a
30
40

BRUSH EXTENSION ARM

BACKGROUND OF THE INVENTION

This invention relates to an angled extension arm for use with a brush, such as a paint brush. More particularly, the invention relates to an extension arm that is adapted to move between a plurality of fixed positions such that different angles of address are provided for the brush during the work operation.

In painting, for example, a good deal of time and effort is expended in trying to position the brush in difficult to reach areas and to effectively and easily paint the areas once the proper angle of attack has been achieved. The foregoing presents a rather difficult and time consuming problem facing the painter.

The prior art teaches that there are many types of extensions for holding brushes, for example, U.S. Pat. Nos. 2,395,245; 2,792,581; 3,357,035; 3,413,043; 3,737,187; and others. These devices are deficient in that they fail to provide for effective stabilization of the brush thereby increasing the incidence of poor craftsmenship; they are complicated in operation and construction; and they fail to effectively position the brush relative to the work area.

SUMMARY OF THE INVENTION

It is accordingly an object of the instant invention to avoid one or more drawbacks of the prior art.

It is another object of the invention to provide for an extension device as aforedescribed.

It is still a further object to achieve that the same at relatively little cost.

These and other objects of the invention will become more apparent from the following detailed disclosure and claims, and by reference to the accompanying drawings, in which:

Figures 1, 2, 3, 4, 5, 6:
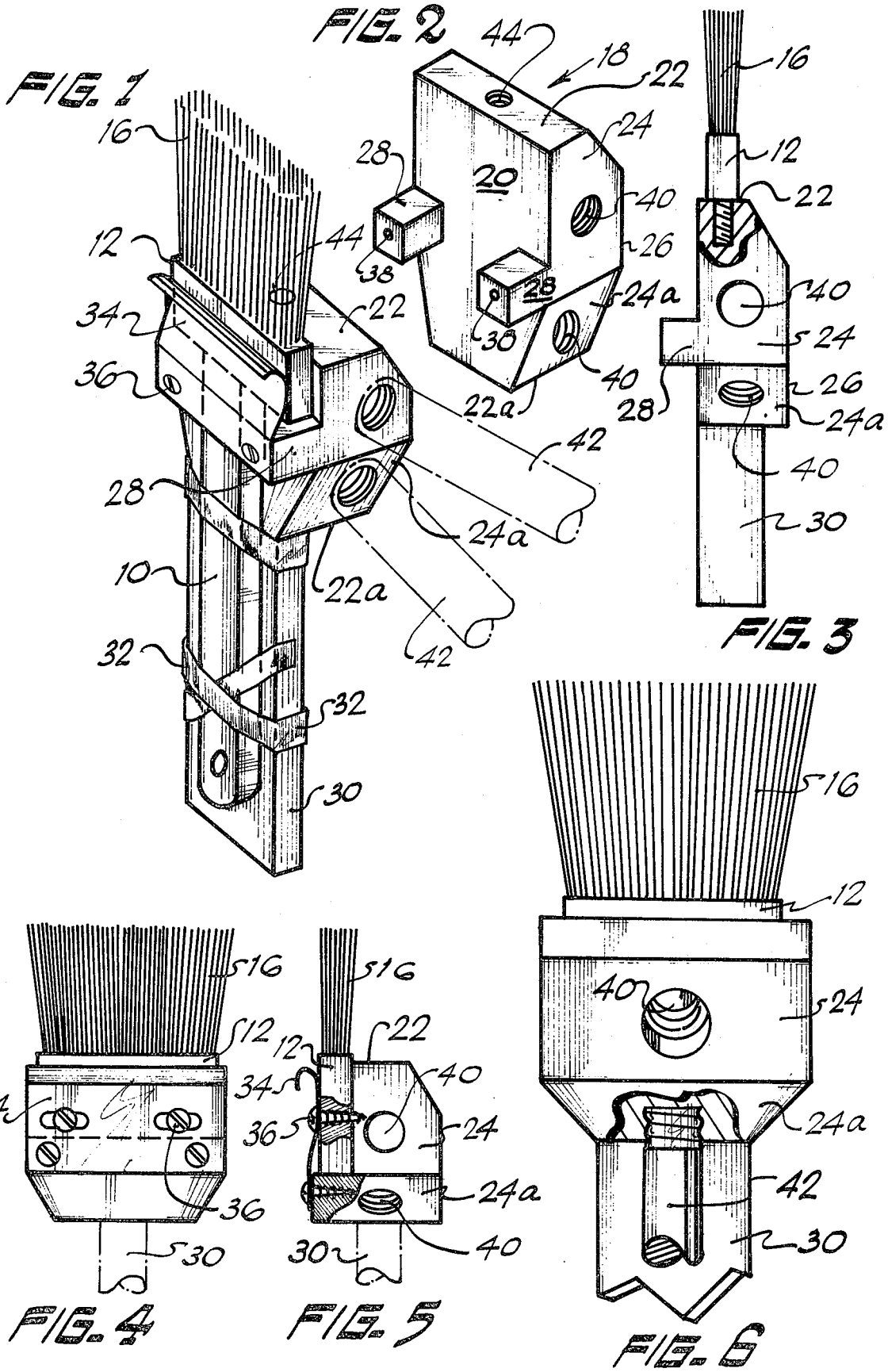
FIG. 1 is a side elevational view of the device with brush partly in perspective.
FIG. 2 is a partial front elevational view of the block portion of the extension device.
FIG. 3 is a side elevational view, partly in perspective, of the block, extension arm portion and brush.
FIG. 4 is a front elevational view similar to FIG. 3.
FIG. 5 is similar to FIG. 3.
FIG. 6 is a rear elevational view similar to FIG. 3.

Broadly speaking, the instant invention includes the provision of an extension attachment for adjustably holding a brush and adapted to be mounted on the upper end of an elongated rod, comprising a multi sided universal block having a substantially planar base portion and a plurality of facets therearound and an elongated arm extension, the base portion including a pair of legs, the base portion adapted to receive a brush thereagainst, the brush adapted to be vertically supported by the legs, the handle of the brush adapted to communicate between the legs, the arm being in alignment with the handle, a plurality of ferrules on the facets of the block, each of the ferrules having an internally threaded socket attachable to an externally threaded handle bar adapted to engage the same whereby the angle of the brush relative to a work piece may be varied.

DETAILED DESCRIPTION

Referring more particularly to the drawings, in which like elements are designated by like numerals, there is shown the instant device with a brush mounted thereon. The brush may be a conventional house painter's brush or the like and will comprise an elongated handle portion 10, terminating in mounting body 12 housing a plurality of parallel bristles 16. The extension arm comprises a universal block 18 that is substantially eight or nine sided in shape, though the same need not. The block 18 may be constructed of any suitable rigid material, such as wood, plastic, metal or the like. The block 18 will preferably have a substantially planar base portion 20, three planar side portions **22, 22*a*, 22*b*, one other side portion defining two opposing angled facets 24, 24*a* and a top portion 26.**

The base portion 20 will further include a pair of legs 28 or brush stabilizing arms. The base portion 20 is adapted to receive the mounting portion 12 of the brush thereagainst, supported by the pair of legs 28, disposed at an angle of about 90° to said base such that the handle 10 of the brush passes between the legs 28 and lies substantially flat against the remainder of the base portion 20. The legs 28 are preferably disposed approximately centrally on said base portion 20.

In the preferred embodiment integral and preferably unitary with the block 18 and extending downward therefrom, in axial alignment therewith is an elongated arm 30 that may further help to stabilize the brush by receiving the remainder of the handle 10 thereon. If desired, one or more strap means 32, such as rubber bands, straps, or the like may be integral with the arm 30 to facilitate stabilization of the handle 10 thereagainst.

In yet a further embodiment, a resilient member 34 such as a spring clip or the like may be disposed on the block 18 in communication with the legs 28 such that it exerts pressure against the mounting body 12 forcing the same to remain in contact with portion 20. Body 12 will thereby be sandwiched between portion 20 and means 34. Means 34 can be removably attached, such as by suitable means 36, i.e., screws, mating with a chamber 38 in legs 28.

Each of the frusto-conical wall sections 24 and 24a will define a standard broomstick recess or ferrule 40 that has an internally threaded socket to accommodate the external threads on standard broomstick handle bar 42.

The opposite end of the ferrule is closed. As is apparent, the stick 42 thereby provides for either an angle of 45° or of 90° for addressing the brush relative to the work area. Where only the arm 30 is employed, the brush is disposed vertically or at an angle of 180° relative to the work area. Side wall 22, which wall is perpendicular to the bristles 16 may also be provided with a chamber 44 similar to chamber 40 for like accommodation.

By the term "universal block" there is meant a block having internally threaded recesses adapted to receive conventionally externally threaded broomsticks or poles therein.

Since it is obvious that numerous changes and modifications can be made in the above-described details without departing from the spirit and nature of the invention, it is to be understood that all such changes and modifications are included within the scope of the invention.

I claim:

1. An extension attachment for adjustably holding a brush and for use in combination therewith and adapted to be mounted on the upper end of an elongated rod, comprising a multi-sided universal block having a substantially planar base portion and a plurality of facets therearound and an elongated arm extension, said base portion including a pair of legs centrally located on the base, spaced apart, and extending outwardly and substantially perpendicular to said base, said base portion adapted to receive a brush thereagainst, the brush adapted to be vertically supported by said legs, the handle of the brush adapted to communicate between said legs, a plurality of ferrules on said facets of said block, each of said ferrules having an internally threaded socket operative to mate with an externally threaded distal end on a rod whereby the angle of a brush relative to a work piece may be varied, said block further including resilient means secured to said legs extending substantially parallel to said base and adapted to engage a brush against said base portion.

2. An attachment as defined in claim 1 wherein said resilient means is a spring clip.

3. An attachment as defined in claim 1 wherein one end of said block defines a two opposing facets each having a ferrule therein.

4. An attachment as defined in claim 1 wherein said block has at least eight sides.

5. An attachment as defined in claim 1 in combination with a brush.

* * * * *